United States Patent [19]

Sutter

[11] 4,389,931

[45] Jun. 28, 1983

[54] APPARATUS FOR THE COMPACTION OF FIBERS

[75] Inventor: Hanspeter Sutter, Uster, Switzerland

[73] Assignee: Luwa AG, Zurich, Switzerland

[21] Appl. No.: 284,972

[22] Filed: Jul. 20, 1981

[30] Foreign Application Priority Data

Aug. 5, 1980 [CH] Switzerland ..... 5921/80

[51] Int. Cl.[3] ..... B30B 9/00

[52] U.S. Cl. ..... 100/90; 100/192; 100/266; 100/269 R; 100/295; 55/337; 141/67; 141/73

[58] Field of Search ..... 100/90, 91, 266, 269 R, 100/295, 211, 144, 179, 187, 192, 147; 141/12, 67, 71, 73; 55/337, 454

[56] References Cited

U.S. PATENT DOCUMENTS

| | | | |
|---|---|---|---|
| 2,488,395 | 11/1949 | Goldberg | 100/91 |
| 2,524,560 | 10/1950 | Cote | 141/12 |
| 2,813,569 | 11/1957 | Nelson | 100/266 X |
| 2,954,730 | 10/1960 | Moser | 100/90 |
| 3,104,609 | 9/1963 | Crawford | 100/192 X |
| 3,601,955 | 8/1971 | Ferri | 100/90 X |
| 4,162,418 | 7/1979 | Kawaki | 310/49 R |
| 4,199,333 | 4/1980 | Ferri | 55/337 X |

FOREIGN PATENT DOCUMENTS 2254490 3/1973 Fed. Rep. of Germany .

*Primary Examiner*—Billy J. Wilhite
*Attorney, Agent, or Firm*—Werner W. Kleeman

[57] ABSTRACT

A substantially funnel-shaped constricting fiber chute or shaft possesses at its lower portion blade springs forming a diaphragm or the like. These blade springs extend at an acute angle with respect to the lengthwise axis of the fiber chute. At their free ends these blade springs delimit an exit or outlet opening, by means of which the fiber chute opens into a container, such as a bag or sack or the like which is exchangeably secured at such fiber chute. A driveable plunger arranged coaxially with respect to the fiber chute possesses a plunger head which tapers in the outlet direction. The plunger head possesses a toothed or serrated band. Upon penetration of the plunger into the fiber chute or shaft the plunger head compacts fibers which have collected in the fiber chute and expresses such, while further compacting the same, into the sack. The equipment is particularly suitable for use at a fiber separator at which the fibers separated from a transport air current or stream drop into the fiber chute.

10 Claims, 2 Drawing Figures

APPARATUS FOR THE COMPACTION OF FIBERS

BACKGROUND OF THE INVENTION

The present invention relates to a new and improved construction of apparatus for the compaction of fibers or the like.

Generally speaking, the fiber compaction apparatus of the present development is of the type comprising a fiber exit arranged at one side of a housing, a yieldable, enlargeable diaphragm operatively associated with the fiber exit or outlet location and a driveable plunger arranged in the housing and directed towards the fiber exit or outlet opening. This driveable plunger can be moved between a retracted terminal position and an extended or advanced terminal position.

There is already known to the art an apparatus of the type generally discussed above, wherein the housing is formed by the separation chamber or compartment of a fiber separator and which is limited by a cylindrical sieve body. The fiber separator separates the fibers from a transport air current or stream. The separator chamber contains a coaxially arranged displacement body along which there is moveable the plunger which is constructed as a ring-shaped plate member. The spring-elastic elements of the diaphragm extend approximately in a radial plane, and the inner free ends of the elements bear at the underside of the displacement body. During the initial compaction stroke of the plunger the material which has collected below the plunger is compressed together at the diaphragm until the developed pressure lifts the free ends of the spring-elastic elements from the displacement body and bend such free ends upwardly, so that there is produced a passage for the fiber material. During the next following compaction stroke of the plunger additional fiber material is ejected out of the separator chamber through such passage and conveyed into a container merging at the connection elements or studs. With increasing filling of the container, which may be constituted by an air impervious sack or bag, there occurs within the container a proper compaction of the fibers. The diaphragm prevents by means of its spring-elastic elements that upon the return stroke of the plunger fiber material will be moved out of the container or the outlet connections or studs back into the separation chamber.

The compaction of the fibers in the container is however limited by virtue of the fact that such fibers, when they have been ejected between the displacement body and the diaphragm, depart in a ring-shaped compressed configuration and form a hose-shaped tress. The volume of this hose-like tress cannot be appreciably changed during the subsequent compaction of the fibers in the container. Accordingly, for a given size of the container it is necessary to remove relatively frequently a full container from the equipment and to connect an empty container. Additionally, the relatively large volume renders more expensive both the storage and also the transport of the fibers.

The assignee of this application also has obtained by way of example, the following patents relating to fiber handling equipment, namely U.S. Pat. No. 3,601,955, U.S. Pat. No. 4,199,333 and German Pat. No. 2,254,490 and further is aware of U.S. Pat. No. 4,162,418.

SUMMARY OF THE INVENTION

Therefore, with the foregoing in mind it is a primary object of the present invention to provide a new and improved construction of apparatus for the compaction of fibers in a more effective manner than was heretofore possible.

Another and more specific object of the present invention aims at providing a new and improved construction of apparatus by means of which it is possible to more intensely compact fiber material in a container, and thus for instance accommodating within a given container a larger quantity of fibers.

Still a further important object of the present invention aims at providing a new and improved fiber compaction apparatus which is relatively simple in construction and design, extremely economical to manufacture, highly reliable in operation, quite easy to use, not readily subject to breakdown or malfunction, and requires a minimum of maintenance and servicing.

Now in order to implement these and still further objects of the invention, which will become more readily apparent as the description proceeds, the fiber compaction apparatus of the present development is manifested by the features that the fiber outlet forms a chute which in the fiber exit direction reduces in cross-section. At least the exit-side end portion of such chute is formed by the diaphragm. The plunger, in its advanced terminal or end position, penetrates directly into the diaphragm which predominantly is yieldable transversely with respect to the fiber exit or outlet direction.

The solution proposed by the invention affords a considerably better compaction of the fiber material already by virtue of the fact that the fiber tress or strand-like fiber arrangement which effluxes out of the fiber chute or shaft, possesses a solid cross-section. The density of the fibers in such tress is increased in that, the counter pressure exerted by the diaphragm elements actually is effective transversely with respect to the exit or outlet direction of the fibers.

An improved compaction as well as a reliable ejection of the fibers which subsequently flow into the fiber chute can be realised in that, according to a further aspect of the invention, the plunger possesses a head which constrictingly tapers in the exit or outlet direction. Hence, the plunger is not only effective in a single cross-section, rather over the length of the head which penetrates into the fiber chute both with an axial and also a transversely directed component directly upon the fibers and presses such fibers together during fiber conveying.

The cost for operating the equipment as well as for the storage and the transport of the fibers is appreciably reduced by virtue of the improved fiber compaction.

BRIEF DESCRIPTION OF THE DRAWINGS

The invention will be better understood and objects other than those set forth above will become apparent when consideration is given to the following detailed description thereof. Such description makes references to the annexed drawings wherein:

FIG. 1 is a vertical sectional view of a fiber compaction apparatus according to the invention which is provided at a filter box or the like.

DETAILED DESCRIPTION OF THE PREFERRED EMBODIMENTS

Figure 1:
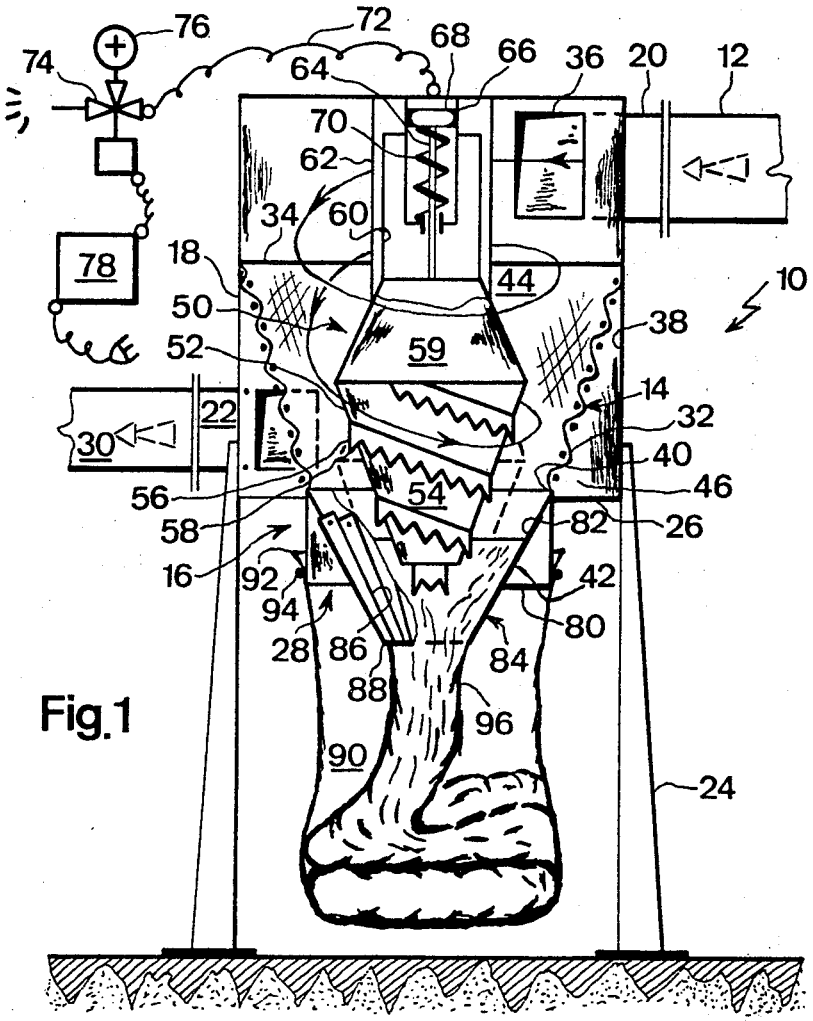

Describing now the drawings, in FIG. 1 reference character 10 generally designates a filter box which is in flow communication by means of a channel or duct 12 with a not here further illustrated source of air which is laden with fiber waste, for instance emanating from a group of textile machines. The filter box 10 comprises a fiber separator 14 as well as an apparatus 16 which merges with the fiber separator 14 and serves for the compaction of the separated out fibers or the like. The fiber separator 14 and the apparatus 16 are housed in a common substantially cylindrical housing 18. This housing 18 possesses, apart from a tangential inlet connection 20 connected with the channel or duct 12, a likewise tangential outlet or exit connection 22 which is offset in axial direction of the housing 18. Finally, the housing 18 which is supported upon supports 24, is provided at its underside 26 with a fiber outlet or exit, generally designated by reference character 28. The outlet connection 22 flow communicates, for instance, with the atmosphere or ambient surroundings by means of a channel or duct 30.

Housing 18 contains a filter body 32, here shown in the form of a truncated cone which is arranged approximately coaxially with respect to the housing 18. At its upper edge 34 the filter body 32 merges below the mouth or opening 36 of the inlet connection 20 at the inner side or wall 30 of the housing 18, whereas its lower edge 40 is secured to a like-wise truncated cone-shaped constricted fiber chute or shaft 42 of the fiber outlet or exit 28.

The filter body or filter means 32 subdivides the interior of the housing 18 into a raw air chamber 44 directly connected with the inlet connection 20 and the fiber chute 42 and a clean air chamber or compartment 46 directly connected with the outlet connection 22.

During operation of the filter box 10 a not particularly illustrated ventilator or equivalent structure conveys the air charged with fibers at an excess pressure from the source through the channel 12 to the inlet connection 20. In the raw air chamber or compartment 44 there prevails a twist or spin flow having an axial component which is downwardly directed by virtue of the pressure drop or gradient. This spin flow exits in the raw air chamber 44 by virtue of the air which has been tangentially filtered-in or infed through the connection 20. Fibers and dust, which deposit at the filter body 32 are gradually transported up to the fiber chute 42 along the surface of the filter body under the action of the remaining twist or spin flow. The spin or twist flow therefore prevents or retards a clogging of the filter body 32 by dust. The air effluxing through the filter body 32 is collected in the clean air chamber or compartment 46 and flows off by means of the exit or outlet connection 22 and the channel 30. By virtue of the tangential arrangement of the outlet connection 22 and opposite to the connection 20 there is augmented the maintenance of the spin or twist flow in the raw air chamber or compartment 44. Since a spin flow also prevails in the clean air chamber or compartment 46 there is obtained a uniform distribution of the air at the circumference of the filter body 32.

According to the invention the apparatus 16 serving for the compaction of the fibers or the like which is integrated into the filter box or cabinet 10, comprises, apart from the fiber outlet or exit 28 constructed as a fiber chute or shaft 42 which decreases in cross-section in the fiber exit or outlet direction, a plunger 50. This plunger or plunger member 50 possesses a plunger head 52 which constrictingly tapers in the fiber exit or outlet direction. As best seen by referring to FIG. 1, the plunger head or head member 52, according to the exemplary illustrated embodiment, possesses the shape of a truncated cone and carries at its jacket surface 54 a helix-line or screw-line shaped band 56, for instance a metal band. The metal band 56 which is provided with downwardly directed teeth or serrations 58 or equivalent structure, extends in the same rotational sense as the spin or twist flow which prevails in the fiber separator 14. Merging with the plunger head 52 the plunger 50 possesses an upwardly conically constrictingly tapering intermediate portion or element 59 which transforms into a guide sleeve 60. Within a guide cylinder 62 which is rigidly secured at the housing 18 there is axially displaceable the guide sleeve 60. By means of a piston rod 64 the guide sleeve 60 is connected with a piston 68 arranged in a drive cylinder unit 66. The drive cylinder unit or drive cylinder 66 secured at the housing 18 coaxially with respect to the guide cylinder 62 contains a restoring spring 70 or the like. This restoring or return spring 70 engages at the underside of the piston or piston member 68 and at its upper side is operatively connected by means of a line or conduit 72 and a three-way valve 74 with a compressed air source 76. A control cabinet 78, which for instance contains a not particularly illustrated but conventional adjustable time control device, is operatively connected with the, for instance, electromagnetically actuatable three-way valve 74.

Figure 2:
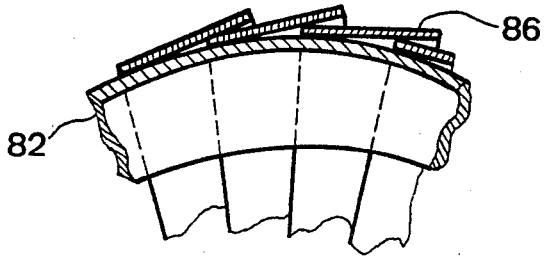
FIG. 2 illustrates in horizontal sectional view and on an enlarged scale details of the construction of FIG. 1.

The fiber chute 42 which is coaxially arranged with respect to the plunger 50 encompasses a conical ring member or ring 82 arranged within a cylindrical ring member or ring 80 as well as a diaphragm 84 or equivalent structure which is formed from a multiplicity of blade or leaf springs 86 or the like. The blade springs 86 are arranged to extend at the outer side of the conical ring 82 approximately along generatrixes and are uniformly distributed at the circumference of the conical ring 82. The blade springs 86 which are secured at their upper ends in any suitable fashion at the ring or ring member 82 mutually overlap in the circumferential direction, as will be apparent from the top plan view of a fragmentary portion of the described arrangement which has been illustrated in detail in FIG. 2. In accordance with the conicity of the ring member 82, at which the blade springs 86 bear, these blade springs extend at an angle of less than 45° with respect to the axis of the fiber chute 42 and with respect to the exit or outlet direction from such fiber chute. The blade springs 86 are therefore predominantly yieldable or resilient in a direction transverse to the approximately vertical outlet direction. The cylindrical ring member 80 enables connection to a suitable container for the reception of fibers. As has been indicated in FIG. 1, such fiber collecting or receiving container can be constituted by a bag or sack 90 formed of air impervious material, which is attached by its open end 92 at the ring member 80 by means of a releasable tensioning band 94 or equivalent fastening means.

During operation of the fiber separator 14 the plunger 50 is located in the full line illustrated upper end or terminal position in which it forms an inner boundary of the raw air chamber or compartment 44. The exit or outlet opening 88 of the fiber chute 42, bounded by the diaphragm elements 86, is blocked by the upper end of a fiber tress or strand-like fiber arrangement 96 which has been formed by the compaction operation which occurred in the compaction apparatus 16. Separated fibers collect in the fiber chute or shaft 42 for as long as the plunger 50 remains in the upper end or terminal position. After a period of time during which the fiber chute 42 has been filled with loose, i.e. uncompacted fibers, the time control of the control cabinet 78 initiates actuation of valve 74 such that compressed air can arrive from the compressed air source 76 at the drive cylinder unit 66. The piston 68 which is impinged with the pressurized or compressed air at its top face propels the plunger 50 downwardly against the action of the restoring or return spring 70. During plunger penetration into the fiber chute 42 the plunger head 52 downwardly presses the collected fibers and also expresses such fibers towards the side. Consequently, the metallic serrated band 56 entrains by means of its teeth or serrations 58 or equivalent structure the fibers which have been expressed or displaced towards the side during the further downward movement of the plunger 50. Once the plunger 50 has reached its lower end or terminal position, illustrated in broken lines in FIG. 1, then the fiber bales which have been produced and compressed by such plunger 50, have for the most part been ejected out of the fiber chute or shaft 42. Under the action of the pressure exerted by the plunger 50 upon the fiber bales or the like such fiber bales have been compacted and upon departure through the outlet opening 88 have formed into a tress or strand-like fiber portion which merges with the previously formed tress or strand-like fiber portion 96. Under the pressure transmitted by the fibers the blade springs 86 have moved transversely with respect to the lengthwise axis of the plunger 50 and assumed a pre-biased or pre-stressed condition. If after a certain time the cylinder unit 66 is vented by switching the valve 76, then the restoring spring 70 can retract the plunger 50 into the upper terminal position. Consequently, the fibers remaining in the fiber chute or shaft 42 during retraction of the plunger 50, are retained and compressed together by the pre-biased and now inwardly resiliently acting blade springs 86. During the further filling of the bag or sack 90, the blade springs 86 prevent that fibers can again move upwardly, under the action of the increasing internal pressure, and penetrate into the fiber chute 42 in that they retain the opening 88 blocked by a compact fiber tress portion or strand-like fiber portion.

To the extent that during the retraction of the plunger 50 out of the fiber chute 42 fiber bunches remain caught at the plunger head 52 these entrained fiber bunches or the like arrive at the raw air chamber 44 under the action of the spin or twist flow prevailing within such raw air chamber. Since this spin flow not only flows over the plunger 50 as well as over the part of the guide sleeve 60 which protrudes past the guide cylinder 62, but also follows the extent or course of the metallic band 56 of the plunger head 52, fiber bunches which for instance have become entrapped at the serrations or teeth 58 are detached, so that they can drop into the fiber chute 42 under the force of gravity. The course of the intermediate element 59 prevents any deposit of fibers at the plunger 50, and thus counteracts the tendency of the fibers to form in the lowered plunger position at its surface a ring-shaped fiber bale or plug.

The arrangement of the moveable parts of the compaction apparatus in the fiber separator and its raw air chamber has a beneficial effect upon the function thereof. Since, in particular, the plunger fills the central portion of the raw air chamber or compartment, there are maintained relatively high air velocities at the region of the filter body 32. Hence, there is enhanced the cleaning of the filter surface.

While there are shown and described present preferred embodiments of the invention it is to be distinctly understood that the invention is not limited thereto but may be otherwise variously embodied and practised within the scope of the following claims.

Accordingly, what I claim is:

1. An apparatus for the compaction of fibers comprising:

a housing;

means defining a fiber outlet arranged at one side of said housing;

a yieldable and expandable diaphragm means operatively associated with the fiber outlet;

a driveable plunger arranged in said housing and directed towards said fiber outlet;

means for moving said driveable plunger between a retracted terminal position and an advanced terminal position;

said means providing said fiber outlet forming a fiber chute which decreases in cross-section in a fiber outlet direction;

said fiber chute having an end portion located at an outlet side of said fiber chute;

at least said end portion of said fiber chute being formed by said diaphragm means;

said plunger, in its advanced terminal postion, directly penetrating into said diaphragm means; and said diaphragm means being predominantly resilient in a direction transverse to said fiber outlet direction.

2. The apparatus as outlined in claim 1, wherein:

said plunger possesses a plunger head which constrictingly tapers in the outlet direction.

3. The apparatus as outlined in claim 2, wherein:

said diaphragm means comprises blade springs; and said blade springs extending at an angle of less than 45° with respect to the fiber outlet direction.

4. The apparatus as defined in claim 1, wherein:

said diaphragm means comprises blade springs; and said blade springs extending at an angle of less than 45° with respect to said fiber outlet direction.

5. The apparatus as defined in claim 4, wherein:

said fiber chute encompasses a substantially conical ring member;

said conical ring member having an outer surface; and said blade springs being secured at upper ends thereof at the outer surface of said conical ring member.

6. The apparatus as defined in claim 5, wherein:

said blade springs mutually overlap in circumferential direction.

7. The apparatus as defined in claim 2, wherein:

said plunger head is constricted in a step-like manner.

8. The apparatus as defined in claim 2, wherein:

said plunger head possesses a substantially truncated conical configuration;

said plunger head having an outer surface; and at least one metallic band provided with downwardly directed serrations provided at said outer surface of said plunger head.

9. The apparatus as defined in claim 8, wherein:

said metallic band extends at the outer surface of said plunger head in the form of a screw line.

10. The apparatus as defined in claim 1, further including:

fiber separator means containing tangential air entry means arranged in said housing;

said fibers separator containing a raw air chamber and a clean air chamber;

said plunger, in the retracted terminal position thereof, being located in the raw air chamber; and a filter body structured as a body of rotation and separating the clean air chamber from the raw air chamber.

* * * * *